United States Patent [19]

Baron

[11] 4,108,452

[45] Aug. 22, 1978

[54] SKATE BOARD SAFETY ACCESSORY

[76] Inventor: Richard Alan Baron, 26 A Cyprus La., Old Bridge, N.J. 08857

[21] Appl. No.: 748,275

[22] Filed: Dec. 6, 1976

[51] Int. Cl.[2] ..... A63C 1/18

[52] U.S. Cl. ..... 280/11.3; 36/15; 280/87.04 A

[58] Field of Search ..... 280/11.3, 11.37 N, 11.37 A, 280/11.37 H, 87.04 R, 87.04 A, 613; 9/310 E, 310 D; 36/15

[56] References Cited

U.S. PATENT DOCUMENTS

| | | | |
|---|---|---|---|
| 2,685,141 | 8/1954 | Davenport | 280/11.3 UX |
| 3,368,811 | 2/1968 | Finney | 280/11.37 H X |
| 3,954,279 | 5/1976 | Guerr | 280/87.04 A |

*Primary Examiner*—Joseph F. Peters, Jr.
*Assistant Examiner*—Gene A. Church
*Attorney, Agent, or Firm*—Stephen W. White

[57] ABSTRACT

A safety accessory that can be used with skate boards is described. This accessory comprises two elements which are attached to the riding surface of the skate board and to the feet of the rider. This accessory permits the rider to exercise greater control during performances on the skate board. The releasable safety function of this accessory is particularly useful during the execution of acrobatics on the skate board and allows even the most inexperienced of riders to perform tricks normally executed by a skilled artisan of skate board riding.

8 Claims, 4 Drawing Figures

SKATE BOARD SAFETY ACCESSORY

BACKGROUND OF THE INVENTION

1. Field of the Invention

This invention is directly related to skate boards and specifically related to a novel accessory for use therewith. More specifically, this invention is related to an accessory which improves the utility of the skate board and concurrently reduces the danger of falling during said use thus greatly enhancing the safety of the rider.

2. Description of the Prior Art

Skate boards have been widely used for some time. Almost with the inception of the roller skate, children have been removing the roller portions from the skate and attaching them to scraps of lumber so as to form elongated skating mechanisms that may be ridden in an unusual fashion. Recently, however, newly found materials and manufacturing techniques have greatly improved the older, crude concept of the skate board. These facts are well described in U.S. Pat. No. 3,954,279, dated May 4, 1976 and in the prior art cited therein. These improved models of skate board have led to the formation of an entire sport or "cult" involved with their use. These sports include various contests and races which follow a prescribed course to test the users' skill. The contests also include tests of acrobatic skills performed by the rider while in motion thereon. Since the improved skate boards can be pushed to a high rate of speed, and since races or contests are usually conducted on courses which are surfaced with macadam, cement and like materials, accidents can result in serious injuries to the riders. These accidents are particularly prevalent when the skate board rider is attempting to perform acrobatic stunts and the like.

SUMMARY OF THE INVENTION

It is an object of this invention to provide an accessory for use with a skate board which will give the rider of said skate board much greater control in the use thereof and thus enhance the ride and performance while at the same time adding to the satety of the rider by reducing accidents associated therewith.

Accordingly, the objects of this invention are achieved by providing a separable fastening device comprising at least two flexible base sheet members, one of said members having a very large number of closely spaced, interengagable hooking elements of resilient material, and the other of said members having a very large number of closely spaced flexible loops of resilient material, with said hooking elements secured to said base sheet member generally in a vertical position extending from one surface of the base sheet to which they are secured, and the number of loops of the other base member being substantially greater than the number of hooks per unit area of said members, whereby when said surfaces of said members are pressed together in a face-to-face relationship, a number of said hooks will engage with a number of said loops to secure the base sheet members together, one of said base sheet members being attachable to the riding surface of the skate board and the other base sheet member being attachable to at least one of the feet of the rider of said skate board.

DETAILS OF THE INVENTION

Although the basic, component parts of this invention are well-known in their various and particular art fields, the combination of elements to form the accessory of this invention has not been previously described, nor could the unusual and special effects noted when this accessory was first made and tried by the inventor have been predicted from a simple knowledge of the various elements which were combined to form the accesory described herein. Basically, this accessory involves the employment of a special fastening means already in wide use for closures on garments and the like. These unusual devices are well described, for example, in U.S. Pat. No. 3,009,235, dated Nov. 21, 1961, and are commonly sold under the tradename of VELCRO® by Velcro Corporation, 681 Fifth Avenue, New York, N.Y., 10022. VELCRO® is characterized by its remarkable and easily engagable parts which can also be separated at the desire of the user. There is sufficient holding power between the two, elemental parts of VELCRO® to resist casual separation, yet they can be disengaged when wanted. VELCRO® has found wide usuage in the garment industry and has replaced common zippers in many instances. To practise the concepts of this invention, one merely attaches one, resilient base member part of VELCRO® to the upper, riding surface of a skate board, and the other base member to the bottom of at least one of the feet of the rider. The rider then steps on the skate board in the usual manner and prepares to ride. When desired, the feet of the rider can be engaged with the upper, riding surface of the skate board by contact with the opposing VELCRO® element base member attached thereto. Since the riding surface of the skate board is now firmly affixed to at least one of the feet of the rider, the rider can exercise much greater control over the movement and the course which the skate board will take during the ride. This results in a much safer ride for the rider since there is less danger that his feet will slip off during the ride and be injured by contact with the ground. Surprisingly, however, this ride control results in a greater ability to perform acrobatics during the ride.

The VELCRO® members may be attached to the feet of the rider and to the riding surface of the skate board in any conventional manner. For example, separate portions of VELCRO® may be attached at any desired position on the riding surface of the skate board by the use of glues or cements. Alternatively, these portions may be tacked down using small nails, or staples, etc. The VELCRO® may be attached to the feet of the rider in a like manner, e.g. by gluing or cementing these portions on the shoes worn by the rider. In yet another embodiment, those portions of VELCRO® to be attached to the feet of the rider may first be attached to an elastic or strap designed to be slipped on or tied to the feet and then to be removed when no longer needed.

Figure 1:
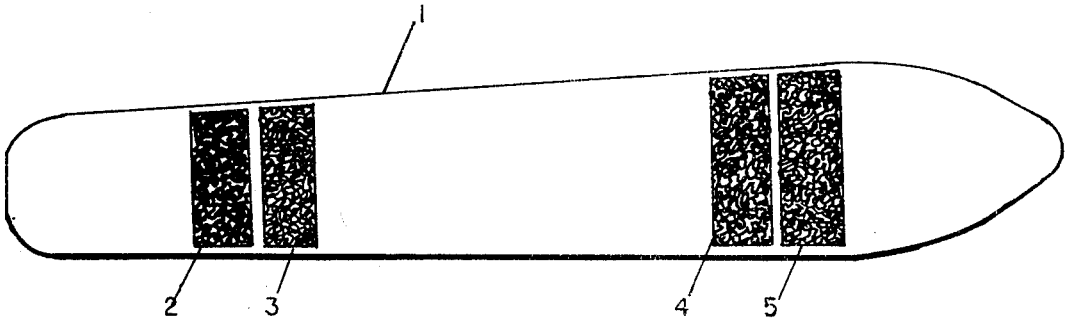
FIG. 1 is a view of the upper surface of a conventional skate board having several base members of the accessory of this invention attached thereto.

When in use, the accessory of this invention permits the rider to choose as much or as little control as desired. Thus, the ultimate in control during a typical ride requires that VELCRO® be attached to both feet of the rider and that opposing VELCRO® elements be placed at several strategic locations on the riding surface of the skate board. Usually, two or more portions of VELCRO® are attached to the tip of the skate board and two or more at the tail portion of the riding surface of the skate board. Both feet of the user will preferably have VELCRO® elements attached to the soles thereof or to the shoes in some manner. The above mentioned positions and number of VELCRO® elements represent the best mode of this invention since this configuration permits the ultimate in ride control. Additionally, this configuration allows the rider control during the performance of acrobatics and hence, inherently, yields the safest ride for the rider. The preferred arrangement of VELCRO® on the riding surface of the skate board is shown in FIG. 1, where 1 is the riding surface and 2, 3, 4, and 5 are strips of VELCRO® of an appropriate size located thereon. The number of strips, the size of each individual strip and the ultimate position on the riding surface is a matter of choice for the rider as well as a function of the size of the skate board being used.

Figure 2:
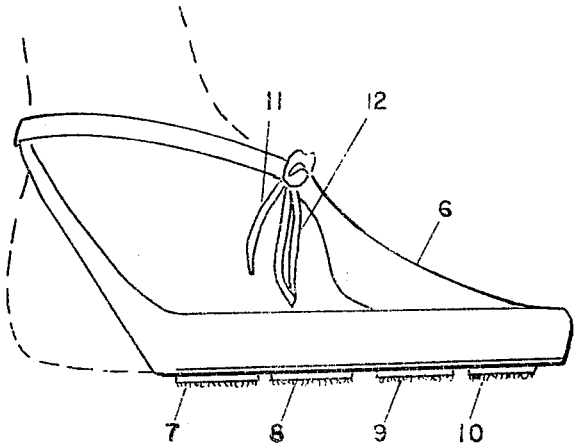
FIG. 2 is a side view of one of the feet of a rider for said skate board wearing a sandal embodiment from this invention having several base members of the accessory of this invention attached to the sole thereof.
Figure 3:
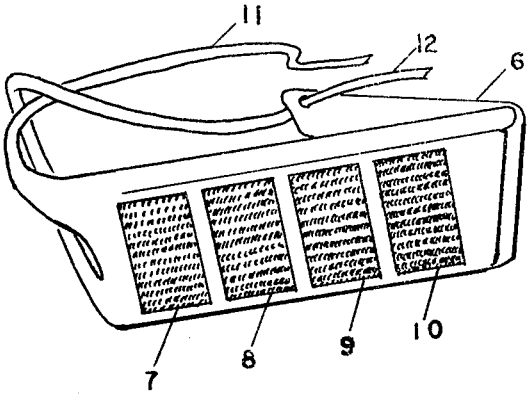
FIG. 3 is a bottom view perspective of the embodiment from FIG. 2.

FIG. 2 demonstrates an embodiment of this invention for attaching the VELCRO® elements to the feet of the rider. This side view of a foot shows a sandal configuration which may be tied to the feet of the rider or worn over the shoes. The sandal may be made from leather or a similar material. In this figure, 6 is the sandal and the raised portions 7, 8, 9, and 10 represent four portions of VELCRO attached thereon. In the figures attached to this specification, the VELCRO® portions attached to the feet are shown as the "loop" elements and those attached to the riding surface of the skate board as the "hook" elements. The two elements may, of course, be reversed and still perform the desired function. FIG. 3 is a bottom view of the sandal of FIG. 2. This view shows the sandal removed from the foot of the rider and thongs 11 and 12 as being untied. The individual portions of VELCRO® can be seen in their entirety in this view.

Figure 4:
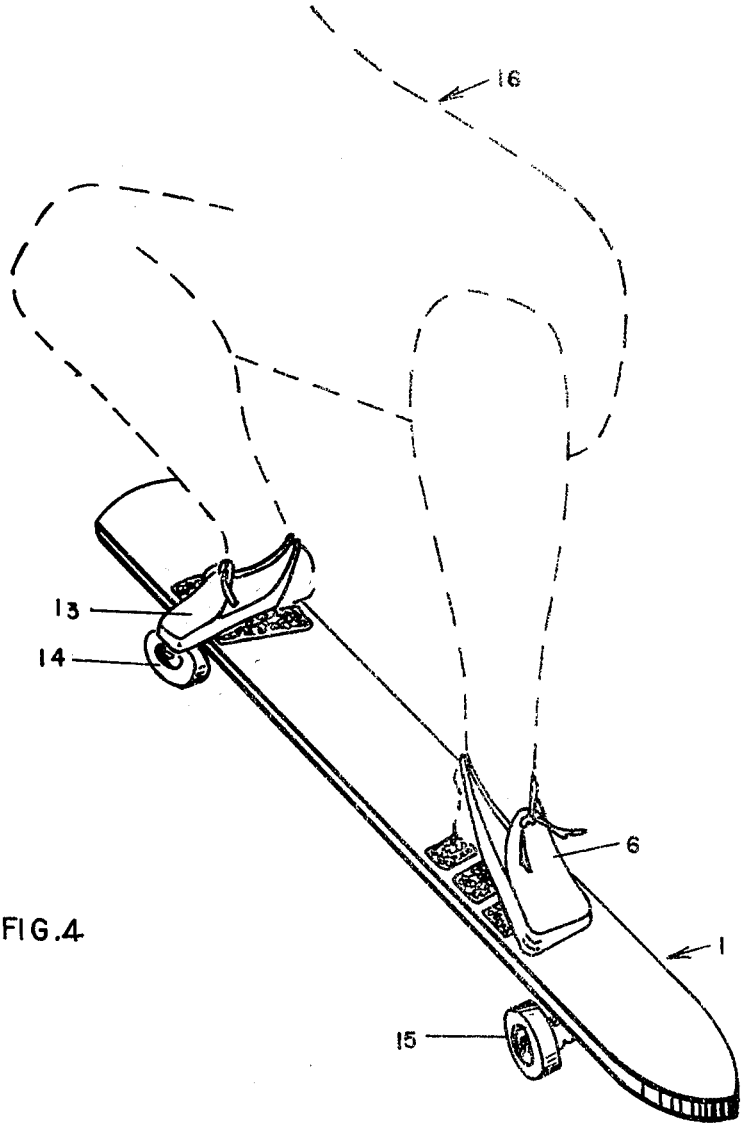
FIG. 4 shows a rider having the sandal embodiment of FIG. 2 on each foot, riding a skate board similar to that of FIG. 1, with the base members of the accessory of this invention in contact with each other.

FIG. 4 is a combination of FIGS. 1 through 3 showing the legs of a rider balanced on a skate board while wearing the sandals of FIG. 2 and FIG. 3. In this view, the portions of VELCRO® attached to the riding surface of the skate board can be seen directly under the feet of the rider and these elements are in full contact with opposite VELCRO® elements attached to the soles of the sandals which are in turn attached to the feet (these portions are, naturally, not shown in this figure). In FIG. 4 the riding surface of the skate board is shown as 1, the sandals as 6 and 13 and the rollers of the skate board as 14 and 15. The rider is shown as 16.

The means of attaching VELCRO® elements to the feet of the rider is, however, not important to the concept of this invention. Any means can be employed with good results. For example, as previously mentioned, the VELCRO® elements may be attached to the footwear of the rider (e.g. shoes, sneakers, etc.). This, however, is not a preferred method since the footwear should be removed after the ride to prevent damage to the VELCRO® elements and this is not convenient. Other attaching means envisioned by the inventor include a portion of elastic bandage containing VELCRO® elements attached thereon. This bandage can then be slipped over the footwear of the rider. Any other attaching means within the metes and bounds of this invention will be obvious to those skilled in the art of skate board manufacture and use thereof.

As previously mentioned, the ability of the rider to exercise great control over the skate board is imperative during skate board competition. This control is greatly enhanced when the rider can utilize the accessory of this invention. This improvement in control was totally unexpected since it was previously thought that it was necessary to be able to constantly move the feet around the riding surface of the skate board during the ride in order to perform the desired acrobatics and to control the course of the skate board during its passage through a pre-determined course. The most convenient position for riding is as shown in FIG. 4. Additionally, the greatest control is achieved from a similar position. When desired, the feet of the rider can be easily separated from the opposing VELCRO® element on the riding surface and moved to another position. This separating or disengaging step is achieved by simply lifting up the foot in a quick, twisting motion. This particular motion serves to separate the VELCRO® elements and the riders's feet can then be repositioned on the riding surface. This is the great simplicity of this invention. Control and safety is improved when the accessory is used and yet none of the previous advantages are lost.

As previously mentioned, a very great advantage is noted when acrobatics are performed using a skate board equipped with the accessory of this invention. There are a whole host of commonly performed tricks that riders employ both for pleasure and during the competetive events. New acrobatics are, of course, being invented every day by the more proficient riders. Two of the more commonly performed acrobatics in which the accessory of this invention was found to be particularly useful are "walking the board" and "jumping." Both of this tricks did require that the rider be bare footed since it was necessary to grip the edge of the riding surface with the toes during the performance thereon. In "walking the board" the rider leans alternatively on one end of the riding surface or the other while the board is moving forward on its wheels. By leaning sufficiently hard on one end, the other end was naturally forced into the air. The rider would then grip the end which was so elevated with his toes and force the raised end forward. A repeat of this process on the other end forced the board to "walk" during the ride. This, of course, was very hazardous to the rider since he was bare footed. Any fall usually resulted in fairly severe injury to the rider's exposed feet. However, when the VELCRO® accessory of this invention is used, the feet are attached to the riding surface and thus the board can be lifted and "walked" without gripping the edge with the toes. The rider can then wear protective footwear greatly lessening the chance of injury during an accidental fall.

The "jumping" acrobatic trick was performed in a manner similar to that described above. The rider grips the edge of the board on both ends with the toes and "jumps" into the air pulling the board with his feet. The rider again was forced to be bare footed and ran similar chances for injury. Using the VELCRO® accessory of this invention the feet can be attached to the riding surface via the accessory and "jumping" can be accomplised very easily. Shoes or other protective footwear then lessens the chance for injury.

Many other acrobatics can also be performed well using the VELCRO ® accessory of this invention. The accessory permits the rider to perform the acrobatics easily, more gracefully and with far greater safety than any of the other devices used to "roughen" the surface of the board and said to improve control. These devices — such as pieces of sandpaper and the like attached to the riding surface — were claimed to improve control since they reduced the lubricity of the riding surfact of the board. However, these elements were not generally successful and are not widely used. The accessory of this invention can be used with much greater results. Although the separation motion in order to disengage the accessory during the ride does require minimal practise to perfect, the action still is within the skill of those who normally perform on skate boards and the ultimate in skate board control and safety far outweighs this slight inconvenince.

What is claimed is:

1. An accessory for a skate board, said skate board having a rolling means and an upper, riding surface, said accessory comprising two, interengagable, opposing elements, one of said elements comprising a thin, flexible, base sheet member having two, flat, opposing surfaces, one of said surfaces having a very large number of closely spaced hooking elements of flexible, resilient material attached thereto, with said hooking elements secured to said surface area of said base member generally in a vertical position extending from said surface, and an attaching means on the opposing flat surface, the second of said elements comprising a thin, flexible base member having two, flat, opposing surfaces, one of said surfaces having a very large number of closely spaced flexible loops of resilient material, the number of said loops being substantially greater than the number of hooking elements per unit area of said surface area, and an attaching means on the opposing flat surface area, whereby one of said elements is attachable by its respective attaching means to the riding surface of said skate board and the other of said elements is attachable by its respective attaching means to a foot of a rider of said skate board, so that when said foot having said element attached thereto is caused to contact the opposing member attached to said riding surface of said skate board, a number of said loops will engage a number of said hooking elements to secure the elements generally in a face-to-face relationship.

2. The accessory of claim 1 whereby element base members are attachable to both feet of said rider.

3. The accessory of claim 2 wherein said riding surface of said skate board has two of said elements located generally on the front portion of said riding surface and two of said elements located generally on the tail portion of said riding surface.

4. The accessory of claim 3 wherein said elements are attached by gluing to the riding surface of said skate board and to the footwear of said rider.

5. The accessory of claim 4 wherein the means for attaching said elements to said feet are a sandal and there are four elements glued to the soles of said sandal.

6. The accessory of claim 5 wherein said sandal is a leather sandal.

7. The accessory of claim 6 wherein said leather sandal is attachable to the feet of the rider by means of leather thongs.

8. The accessory of claim 7 wherein said elements are VELCRO ® elements.

* * * * *